US011760084B2

(12) United States Patent
Hattori

(10) Patent No.: US 11,760,084 B2
(45) Date of Patent: Sep. 19, 2023

(54) INK JET PRINTING APPARATUS, DUMMY JET METHOD, AND PROGRAM

(71) Applicant: FUJIFILM Corporation, Tokyo (JP)

(72) Inventor: Kazumasa Hattori, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 48 days.

(21) Appl. No.: 17/531,793

(22) Filed: Nov. 21, 2021

(65) Prior Publication Data

US 2022/0080723 A1 Mar. 17, 2022

Related U.S. Application Data

(63) Continuation of application No. PCT/JP2020/021933, filed on Jun. 3, 2020.

(30) Foreign Application Priority Data

Jun. 10, 2019 (JP) ..... 2019-107781

(51) Int. Cl.
*B41J 2/045* (2006.01)
*B41J 2/145* (2006.01)
(Continued)

(52) U.S. Cl.
CPC ..... *B41J 2/0453* (2013.01); *B41J 2/145* (2013.01); *B41J 2002/022* (2013.01); *B41J 2002/14354* (2013.01)

(58) Field of Classification Search
CPC ..... B41J 2/0453; B41J 2/145
See application file for complete search history.

(56) References Cited

U.S. PATENT DOCUMENTS

2011/0057990 A1 3/2011 Heo et al.
2016/0339688 A1* 11/2016 Sasaki ..... B41J 2/16526

FOREIGN PATENT DOCUMENTS

JP H03295663 12/1991
JP 2005096281 4/2005
(Continued)

OTHER PUBLICATIONS

"Office Action of Japan Counterpart Application", dated Oct. 3, 2022, with English translation thereof, pp. 1-6.
(Continued)

*Primary Examiner* — Jason S Uhlenhake
(74) *Attorney, Agent, or Firm* — JCIPRNET

(57) ABSTRACT

There are provided an ink jet printing apparatus, a dummy jet method, and a program which can execute a dummy jet at a dummy jet execution timing in which a use status of a nozzle is taken into consideration. A non-jettable period and a required jetting amount of an ink jet head are set for each nozzle, and in a case where the dummy jet for a dummy jet execution nozzle is executed with a jetting amount insufficient for the required jetting amount, at a determination timing of determining the necessity of execution of the dummy jet, for the nozzle of which a total jetting amount in the non-jettable period is less than the required jetting amount, the dummy jet is not executed in a case where a period from a printing start to a next jetting timing is equal to or greater than a period obtained by adding a determination interval to a period from the printing start to the determination timing.

12 Claims, 12 Drawing Sheets

(51) Int. Cl.
*B41J 2/02* (2006.01)
*B41J 2/14* (2006.01)

(56) References Cited

FOREIGN PATENT DOCUMENTS

| | | | | |
|---|---|---|---|---|
| JP | 2005125593 | | | 5/2005 |
| JP | 2005125593 | A | * | 5/2005 |
| JP | 2005280174 | | | 10/2005 |
| JP | 2006076079 | | | 3/2006 |
| JP | 2009196092 | | | 9/2009 |
| JP | 2010173224 | | | 8/2010 |
| JP | 2013067147 | | | 4/2013 |
| JP | 2013067147 | A | * | 4/2013 |
| JP | 2017185635 | | | 10/2017 |

OTHER PUBLICATIONS

"International Search Report (Form PCT/ISA/210) of PCT/JP2020/021933," dated Aug. 4, 2020, with English translation thereof, pp. 1-5.

"Written Opinion of the International Searching Authority (Form PCT/ISA/237)" of PCT/JP2020/021933, dated Aug. 4, 2020, with English translation thereof, pp. 1-8.

* cited by examiner

FIG. 13

200

| INK | NON-JETTING PERIOD [MINUTE] | INK JETTING AMOUNT | 5 | 10 | 20 | 50 | 100 |
|---|---|---|---|---|---|---|---|
| α | 1 | 100 | C | C | C | B | A |
| α | 10 | 100 | C | C | C | B | A |
| α | 30 | 100 | C | C | C | B | A |
| α | 60 | 100 | C | C | C | B | A |
| β | 1 | 50 | C | C | B | A | A |
| β | 10 | 50 | C | C | B | A | A |
| β | 30 | 50 | C | C | B | A | A |
| β | 60 | 50 | C | C | B | A | A |

INK JET PRINTING APPARATUS, DUMMY JET METHOD, AND PROGRAM

CROSS-REFERENCE TO RELATED APPLICATIONS

The present application is a Continuation of PCT International Application No. PCT/JP2020/021933 filed on Jun. 3, 2020 claiming priority under 35 U.S.C § 119(a) to Japanese Patent Application No. 2019-107781 filed on Jun. 10, 2019. Each of the above applications is hereby expressly incorporated by reference, in its entirety, into the present application.

BACKGROUND OF THE INVENTION

1. Field of the Invention

The present invention relates to an ink jet printing apparatus, a dummy jet method, and a program.

2. Description of the Related Art

In a printing apparatus comprising an ink jet head, nozzles are clogged due to the thickening of ink in the nozzles. In a case of preventing and clearing the clogging of nozzles, a dummy jet is implemented. In the dummy jet, a certain amount of ink is jetted from each nozzle. The dummy jet is referred to as flushing or the like in some cases.

JP2019-196092A discloses an ink jet printing apparatus that decides an appropriate maintenance operation content according to image data and performs maintenance. The apparatus disclosed in JP2019-196092A compares a required ink amount that is required for maintaining a jetting function of a nozzle with an ink amount for printing jetted by each nozzle in a case where printing is performed according to the image data, and sets maintenance in which an ink jetting amount of the nozzle satisfies the required ink amount on the basis of the comparison result.

JP2005-280174A discloses an ink jet printing apparatus that performs a flushing operation. The apparatus disclosed in JP2005-280174A integrates an ink consumption amount jetted within a cap non-coating period for each nozzle row, and adjusts an ink jetting amount in a case of performing the flushing operation according to the ink consumption amount and a printing period.

JP2017-185635A discloses an ink jet printing apparatus that performs a flushing operation. The apparatus disclosed in JP2017-185635A acquires information on the ink jetting amount for each nozzle on the basis of print data, and decides a flushing amount for each nozzle according to an integration result of the ink jetting amount for each nozzle.

SUMMARY OF THE INVENTION

However, in any of the invention disclosed in JP2019-196092A, the invention disclosed in JP2005-280174A, or the invention disclosed in JP2017-185635A, for the execution timing of the maintenance or the like, a use status of the nozzle is not taken into consideration. In a case where the maintenance or the like is performed without taking the use status of the nozzle into consideration, the maintenance is performed for the nozzle that does not require maintenance.

The present invention has been made in consideration of such circumstances, and an object of the present invention is to provide an ink jet printing apparatus, a dummy jet method, and a program which can execute a dummy jet at a dummy jet execution timing in which a use status of a nozzle is taken into consideration.

In order to achieve the above object, the following aspects of the invention are provided.

An ink jet printing apparatus according to a first aspect is an ink jet printing apparatus comprising an ink jet head that includes nozzles for jetting an ink; a dummy jet condition setting unit that sets a non-jettable period as an upper limit of a non-jetting period in which a jettability decrease of the ink jet head does not occur, and a required jetting amount as a lower limit of a jetting amount in the non-jettable period, for each nozzle; and a dummy jet control unit that executes a dummy jet for a dummy jet execution nozzle with a jetting amount insufficient for the required jetting amount, in which, at a determination timing of determining necessity of execution of a dummy jet, the dummy jet control unit executes a dummy jet in a case where a period from a printing start to a next jetting timing is less than a period obtained by adding a determination interval to a period from the printing start to the determination timing, and does not execute a dummy jet in a case where the period from the printing start to the next jetting timing is equal to or greater than the period obtained by adding the determination interval to the period from the printing start to the determination timing, for the nozzle of which a total jetting amount in the non-jettable period is less than the required jetting amount.

According to the first aspect, at the determination timing of determining the necessity of execution of the dummy jet, the nozzle which executes the jetting in the period to the next determination timing executes the dummy jet, and the nozzle which does not execute the jetting in the period up to the next determination timing does not execute the dummy jet. In this manner, it is possible to execute the dummy jet efficiently according to the use status of each nozzle.

In a second aspect, in the ink jet printing apparatus of the first aspect, the dummy jet control unit may determine whether to execute the dummy jet by applying a period that is an integral multiple of a printing period of one page.

According to the second aspect, it is possible to control the execution of the dummy jet in units of pages.

In a third aspect, the ink jet printing apparatus of the first aspect or the second aspect may further comprise a transport unit that transports a continuous printing medium.

According to the third aspect, it is possible to execute the dummy jet of the ink jet head in the ink jet printing apparatus to which the continuous printing medium is applied.

In a fourth aspect, in the ink jet printing apparatus of the third aspect, the dummy jet control unit may execute the dummy jet to a boundary region of a page of the continuous printing medium.

According to the fourth aspect, it is possible to suppress the influence of the dummy jet on the print image.

In a fifth aspect, in the ink jet printing apparatus of any one aspect of the first aspect to the third aspect, the dummy jet control unit may execute the dummy jet in a printing period of a print image according to a content of the print image.

According to the fifth aspect, it is possible to execute the dummy jet without providing the printing medium with a region that receives the jetting ink of the dummy jet.

In a sixth aspect, in the ink jet printing apparatus of any one aspect of the first aspect to the fifth aspect, the dummy jet control unit may execute the dummy jet a plurality of times until the non-jettable period has elapsed from the printing start.

According to the sixth aspect, it is possible to distribute the load in the execution of the dummy jet.

In a seventh aspect, in the ink jet printing apparatus of any one aspect of the first aspect to the sixth aspect, the dummy jet control unit may initialize an elapsed period from the printing start and an ink jetting amount from the printing start, for the nozzle in which the dummy jet has been executed.

According to the seventh aspect, it is possible to execute a dummy jet control for each time of execution of the dummy jet.

In an eighth aspect, in the ink jet printing apparatus of any one aspect of the first aspect to the sixth aspect, the dummy jet control unit may execute the dummy jet for all the nozzles at a timing at which an elapsed period from the printing start and an ink jetting amount from the printing start are initialized.

According to the eighth aspect, it is possible to initialize the jetting state of the ink jet head at the timing at which the initialization of the dummy jet is executed.

In a ninth aspect, in the ink jet printing apparatus of any one aspect of the first aspect to the eighth aspect, the dummy jet control unit may include a dummy jet condition acquisition unit that acquires a relationship between the non-jettable period and the required jetting amount for each printing condition.

According to the ninth aspect, it is possible to acquire the execution condition of the dummy jet for each printing condition. In this manner, it is possible to execute the dummy jet according to the printing condition.

In a tenth aspect, the ink jet printing apparatus of any one aspect of the first aspect to the ninth aspect may further comprise a dummy jet condition storage unit that stores a relationship between the non-jettable period and the required jetting amount for each printing condition.

According to the tenth aspect, it is possible to acquire the execution condition of the dummy jet for each printing condition.

A dummy jet method according to an eleventh aspect is a dummy jet method comprising a dummy jet condition setting step of setting a non-jettable period as an upper limit of a non-jetting period in which a jettability decrease of an ink jet head including nozzles for jetting an ink does not occur, and a required jetting amount as a lower limit of a jetting amount in the non-jettable period, for each nozzle; and a dummy jet step of executing a dummy jet for a dummy jet execution nozzle with a jetting amount insufficient for the required jetting amount, in which, at a determination timing of determining necessity of execution of a dummy jet, the dummy jet step executes a dummy jet in a case where a period from a printing start to a next jetting timing is less than a period obtained by adding a determination interval to a period from the printing start to the determination timing, and does not execute a dummy jet in a case where the period from the printing start to the next jetting timing is equal to or greater than the period obtained by adding the determination interval to the period from the printing start to the determination timing, for the nozzle of which a total jetting amount in the non-jettable period is less than the required jetting amount.

According to the eleventh aspect, it is possible to obtain the same effect as the first aspect.

In the eleventh aspect, it is possible to appropriately combine the same matters as those specified in the second aspect to the tenth aspect. In this case, the constituents responsible for the processing and functions specified in the ink jet printing apparatus can be grasped as the constituents of the dummy jet method responsible for the corresponding processing and functions.

A program according to a twelfth aspect is a program causing a computer to realize a dummy jet condition setting function of setting a non-jettable period as an upper limit of a non-jetting period in which a jettability decrease of an ink jet head including nozzles for jetting an ink does not occur, and a required jetting amount as a lower limit of a jetting amount in the non-jettable period, for each nozzle; and a dummy jet function of executing a dummy jet for a dummy jet execution nozzle with a jetting amount insufficient for the required jetting amount, in which, at a determination timing of determining necessity of execution of a dummy jet, the dummy jet function executes a dummy jet in a case where a period from a printing start to a next jetting timing is less than a period obtained by adding a determination interval to a period from the printing start to the determination timing, and does not execute a dummy jet in a case where the period from the printing start to the next jetting timing is equal to or greater than the period obtained by adding the determination interval to the period from the printing start to the determination timing, for the nozzle of which a total jetting amount in the non-jettable period is less than the required jetting amount.

According to the twelfth aspect, it is possible to obtain the same effect as the first aspect.

In the twelfth aspect, it is possible to appropriately combine the same matters as those specified in the second aspect to the tenth aspect. In this case, the constituents responsible for the processing and functions specified in the ink jet printing apparatus can be grasped as the constituents of the program responsible for the corresponding processing and functions.

According to the present invention, at the determination timing of determining the necessity of execution of the dummy jet, the nozzle which executes the jetting in the period to the next determination timing executes the dummy jet, and the nozzle which does not execute the jetting in the period up to the next determination timing does not execute the dummy jet. In this manner, it is possible to execute the dummy jet efficiently according to the use status of each nozzle.

BRIEF DESCRIPTION OF THE DRAWINGS

FIG. 13 is a table illustrating a relationship between a non-jettable period and a required jetting amount.

DESCRIPTION OF THE PREFERRED EMBODIMENTS

Figure 1:
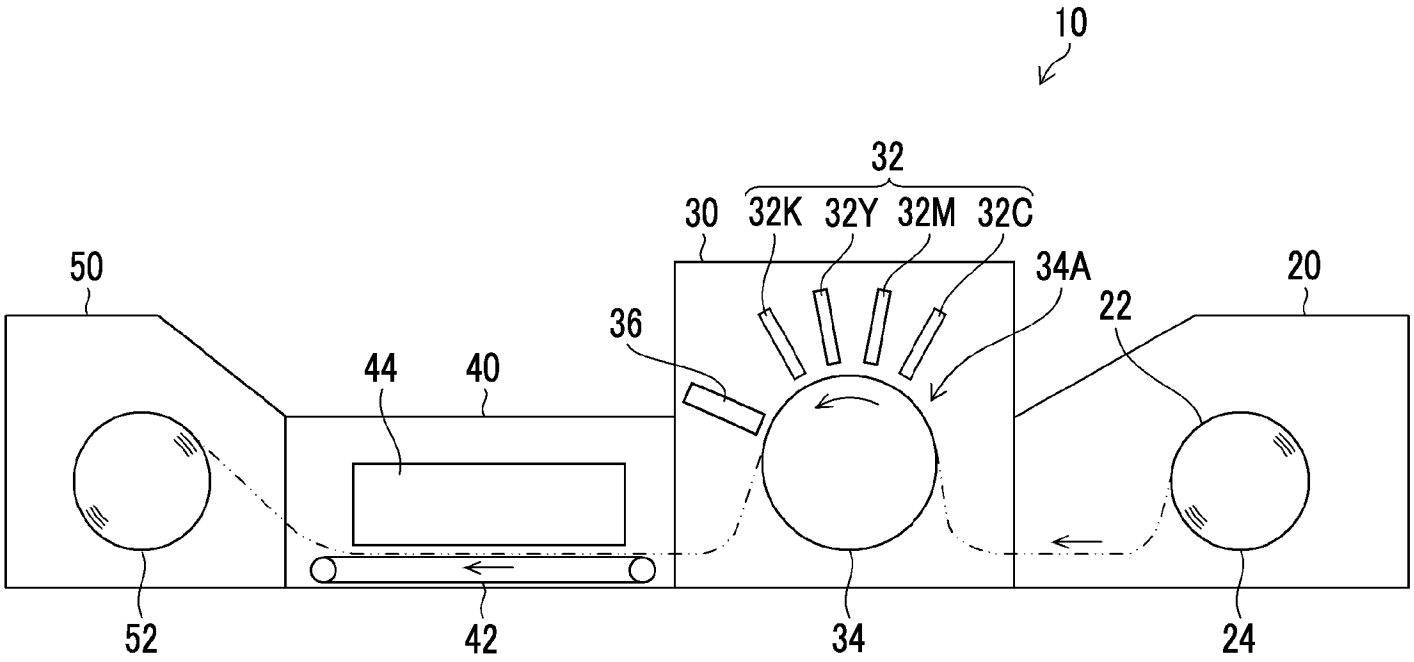
FIG. 1 is an overall configuration diagram of an ink jet printing apparatus according to embodiments.

Hereinafter, preferred embodiments of the present invention will be described in detail with reference to the accompanying drawings. In the present specification, the same constituents are denoted by the same reference numerals, and the redundant description will be omitted as appropriate.

Configuration Example of Ink Jet Printing Apparatus

[Overall Configuration of Ink Jet Printing Apparatus]

FIG. 1 is an overall configuration diagram of an ink jet printing apparatus according to an embodiment. An ink jet printing apparatus 10 illustrated in FIG. 1 comprises a paper feeding unit 20, a printing unit 30, a drying unit 40, and a paper discharge unit 50. In the ink jet printing apparatus 10, roll paper is applied as a continuous printing medium, and continuous printing is executed on the roll paper. A two-dot chain line illustrated in FIG. 1 indicates a transport path of the roll paper.

In the embodiment, flexible packaging is exemplified as the continuous printing medium. The flexible packaging is a material having flexibility, which is applied to food packaging and the like. Examples of the flexible packaging include a plastic film, paper, and aluminum foil.

The paper feeding unit 20 accommodates a feed roll 24 around which the roll paper is wound. The roll paper fed from the feed roll 24 is transported to the printing unit 30. An arrow line indicated in the paper feeding unit 20 indicates a transport direction of the roll paper.

In the following description, the roll paper is referred to as paper 22. The paper 22 which is the roll paper fed from the feed roll 24 described in the embodiment corresponds to an example of a continuous printing medium.

The printing unit 30 comprises an ink jet head 32C, an ink jet head 32M, an ink jet head 32Y, and an ink jet head 32K. The printing unit 30 comprises a printing drum 34. The printing unit 30 comprises an in-line sensor 36.

The ink jet head 32C, the ink jet head 32M, the ink jet head 32Y, and the ink jet head 32K jets a cyan ink, a magenta ink, a yellow ink, and a black ink, respectively.

The printing unit 30 prints a color image on the paper 22 that is adsorbed and supported on an outer peripheral surface 34A of the printing drum 34 by using the ink jet head 32C, the ink jet head 32M, the ink jet head 32Y, and the ink jet head 32K.

The printing unit 30 comprises an in-line sensor 36. The in-line sensor 36 reads the image printed on the paper 22, and outputs read data. The ink jet printing apparatus 10 determines whether there is a defect in the image on the basis of the read data.

In the embodiment, the form in which the printing drum 34 is applied for the transportation of the paper 22 is exemplified, but the form of the transportation of the paper 22 is not limited to the form in which the printing drum 34 is applied. For example, a form in which a transport belt is applied may be applied.

The drying unit 40 comprises a paper transport device 42 and a drying device 44. The paper transport device 42 transports the paper 22 delivered from the printing drum 34. In FIG. 1, a form of comprising the transport belt as an example of the paper transport device 42 is exemplified. For the paper transport device 42, a form of comprising a chain gripper, a form of comprising a nip roller, and the like may be applied. For the paper transport device 42, a plurality of types of transport members may be combined, for example, a combination of a transport belt and a chain gripper.

The drying device 44 performs drying processing on the paper 22 that has been transported using the paper transport device 42. For the drying device 44, a form of jetting hot air, a form of radiating heat, and the like can be applied. For the drying device 44, a plurality of types of methods may be used together.

The paper discharge unit 50 accommodates a winding roll 52 around which the paper 22 is wound. The paper discharge unit 50 may comprise a cutting device that cuts the paper 22 in a prescribed length, and an accumulating device that accumulates the paper 22 that has been cut to the prescribed length. The paper discharge unit 50 may comprise a stamp device that stamps a stamp on a printed matter in which a defect has been found on the basis of an inspection result of the printed matter.

Configuration Example of Printing Unit

Figure 2:
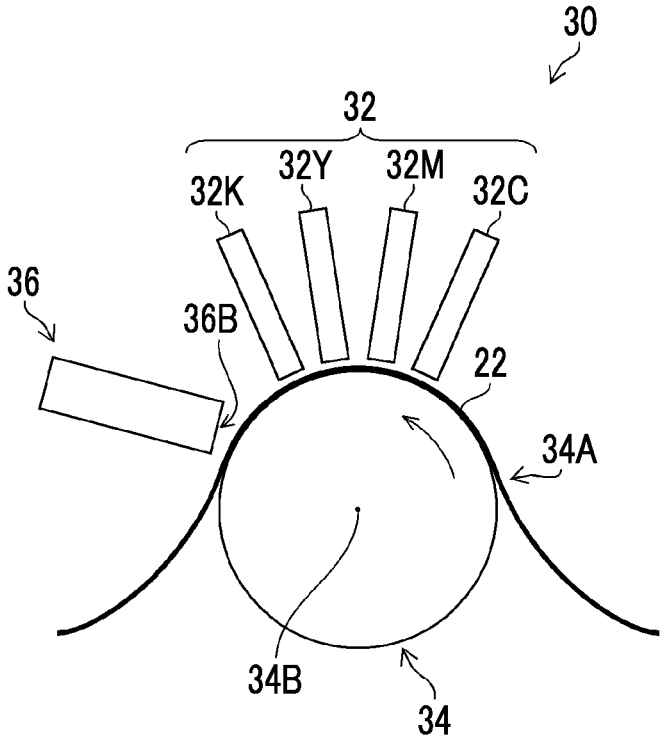
FIG. 2 is a configuration diagram of a printing unit illustrated in FIG. 1.

FIG. 2 is a configuration diagram of the printing unit illustrated in FIG. 1. The same structure can be applied to the ink jet head 32C, the ink jet head 32M, the ink jet head 32Y, and the ink jet head 32K illustrated in FIG. 2. In the following description, the ink jet head 32C and the like may be generically described as the ink jet head 32.

A line type head may be applied to the ink jet head 32. In the line type head, a plurality of nozzles are arranged over the length corresponding to the total length of the paper 22 in a paper width direction. A matrix arrangement can be applied to the arrangement of the plurality of nozzles. The printing unit 30 can execute single pass printing in which the ink jet head 32 and the paper 22 are relatively scanned only once to form an image over the entire printing region of the paper 22.

The paper width direction is a direction orthogonal to a paper transport direction, and represents a direction parallel with a printing surface of the paper 22. The paper transport direction represents a transport direction of the paper 22.

The line type head may be configured by combining a plurality of head modules. For example, the line type head may be configured by arranging the plurality of head modules in a row along the paper width direction. The plurality of head modules may be arranged in two rows in a zigzag pattern.

A piezo jet method can be applied to the ink jet head 32. The piezo jet method is an ink jetting method in which a pressure chamber is pressurized by using the flexural deformation of piezoelectric elements in a case of applying a drive voltage, and the ink in the pressure chamber is jetted from a nozzle opening. The jetting method of the ink jet head 32 may adopt a thermal method by using a membrane boiling phenomenon using a heater provided in the pressure chamber.

The printing drum 34 has a cylindrical shape, and is rotated with a shaft 34B as a rotation axis. The outer peripheral surface 34A of the printing drum 34 comprises a plurality of adsorption holes. The adsorption hole is connected to a pump via an internal flow passage. The pump generates an adsorption pressure in the adsorption hole. The illustration of the plurality of adsorption holes, the internal flow passage, and the pump are omitted.

The printing drum 34 adsorbs and supports the paper 22 on the outer peripheral surface 34A. The printing drum 34 is rotated while supporting the paper 22 on the outer peripheral surface 34A to transport the paper 22. The arrow line indicated in the printing drum 34 indicates the transport direction of the paper 22 in the printing unit 30.

The in-line sensor 36 is disposed at a position on the downstream side of the ink jet head 32K in the paper transport direction. The position and posture of a reading surface 36B facing the paper 22 may be applied to the in-line sensor 36.

[Description of Functional Block of Ink Jet Printing Apparatus]

Figure 3:
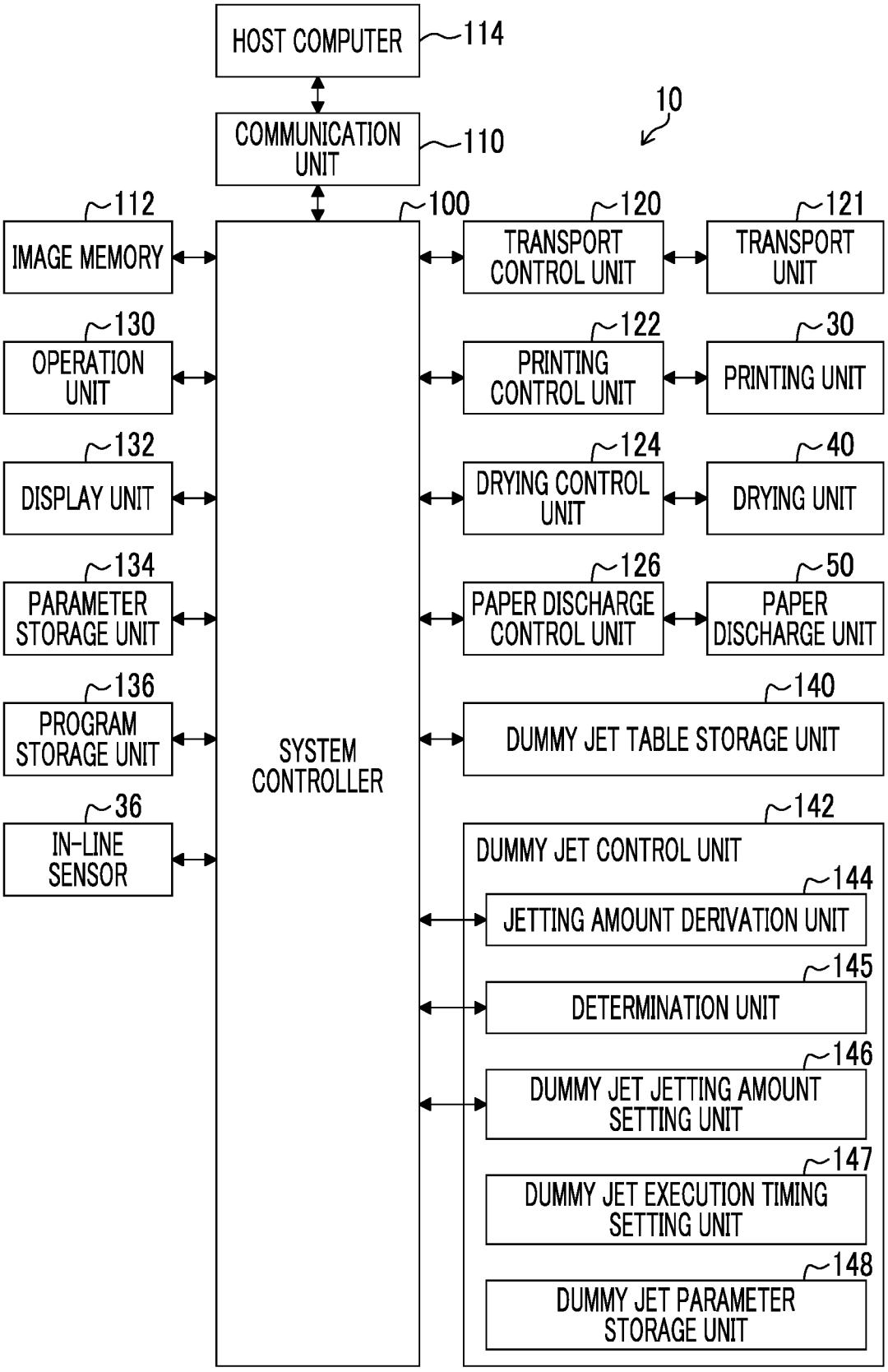
FIG. 3 is a functional block diagram of the ink jet printing apparatus.

FIG. 3 is a functional block diagram of the ink jet printing apparatus. The ink jet printing apparatus 10 comprises a system controller 100. The system controller 100 comprises a central processing unit (CPU), a read only memory (ROM), and a random access memory (RAM). The ROM and RAM may be provided outside the system controller 100. The illustration of the CPU, the ROM, and the RAM is omitted.

The system controller 100 functions as an overall control unit that comprehensively controls each unit of the ink jet printing apparatus 10. The system controller 100 functions as a calculation unit that performs various kinds of operation processing. The system controller 100 may control each unit of the ink jet printing apparatus 10 by executing a program.

The ink jet printing apparatus 10 comprises a communication unit 110. The communication unit 110 comprises a communication interface (not illustrated). The communication unit 110 can transmit and receive data to and from a host computer 114 connected to the communication interface.

The ink jet printing apparatus 10 comprises an image memory 112. The image memory 112 functions as a temporary storage unit of various kinds of data including input image data to be applied to the printing. The reading and writing of data of the image memory 112 are performed through the system controller 100. The image data imported from the host computer 114 via the communication unit 110 is temporarily stored in the image memory 112.

The ink jet printing apparatus 10 comprises a transport control unit 120, a printing control unit 122, a drying control unit 124, and a paper discharge control unit 126.

The transport control unit 120 controls the operation of a transport unit 121 according to a command from the system controller 100. The transport unit 121 illustrated in FIG. 3 includes the printing drum 34 and the paper transport device 42 illustrated in FIG. 1.

The printing control unit 122 controls the operation of the printing unit 30 according to a command from the system controller 100. That is, the printing control unit 122 controls the ink jetting of the ink jet head 32 illustrated in FIG. 3 or the like.

The printing control unit 122 comprises an image data processing unit. The image data processing unit forms dot data from the input image data. The image data processing unit comprises a color separation processing unit, a color conversion processing unit, a correction processing unit, and a halftone processing unit (which are not illustrated). The illustration of the image data processing unit, the color separation processing unit, the color conversion processing unit, the correction processing unit, and the halftone processing unit is omitted.

The color separation processing unit performs color separation processing on the input image data. For example, in a case where the input image data is represented in RGB, the color separation processing unit decomposes the input image data into data for each color of RGB.

The color conversion processing unit converts the image data for each color decomposed into RGB into CMYK corresponding to the ink colors. The correction processing unit performs correction processing on the image data for each color converted into CMYK. Examples of the correction processing include gamma correction processing, density unevenness correction processing, abnormality recording element correction processing, and the like.

The halftone processing unit converts the image data represented by a multi-gradation number such as 0 to 255 into dot data represented by binary or multiple values of three or more values less than the number of gradations of the input image data.

A predetermined halftone processing rule is applied to the halftone processing unit. Examples of the halftone processing rule include a dither method, an error diffusion method, and the like. The halftone processing rule may be changed according to an image formation condition, the content of the image data, and the like.

The printing control unit 122 comprises a waveform generation unit, a waveform storage unit, and a drive circuit. The illustration of the waveform generation unit, the waveform storage unit, and the drive circuit is omitted. The waveform generation unit generates a waveform of a drive voltage. The waveform storage unit stores the waveform of the drive voltage. The drive circuit generates a drive voltage having a drive waveform according to the dot data. The drive circuit supplies the drive voltage to the ink jet head 32 illustrated in FIG. 3 or the like.

That is, the jetting timing and the ink jetting amount at each pixel position are determined on the basis of the dot data generated through the processing by the image processing unit. A control signal for determining the drive voltage according to the jetting timing and the ink jetting amount at each pixel position and the jetting timing of each pixel is generated. The drive voltage is supplied to the ink jet head 32, and the ink is jetted from the ink jet head 32. The ink jetted from the ink jet head 32 forms dots.

The drying control unit 124 operates the drying unit 40 according to a command from the system controller 100. The drying control unit 124 controls a dry gas temperature, a flow rate of the dry gas, a jetting timing of the dry gas, and the like.

The paper discharge control unit 126 operates the paper discharge unit 50 according to a command from the system controller 100. The paper discharge control unit 126 operates a stamp device that stamps a stamp on a printed matter in which a defect in the image has been found.

The ink jet printing apparatus 10 comprises an operation unit 130. The operation unit 130 comprises operation members such as an operation button, a keyboard, and a touch panel. The operation unit 130 may include a plurality of types of operation members. The illustration of the operation member is omitted.

Information input through the operation unit 130 is sent to the system controller 100. The system controller 100 executes various kinds of processing according to the information sent from the operation unit 130.

The ink jet printing apparatus 10 comprises a display unit 132. The display unit 132 comprises a display device such as a liquid crystal panel, and a display driver. The illustration of the display device and the display driver is omitted. The display unit 132 causes the display device to display various kinds of information such as various kinds of setting information and abnormality information of the device according to a command from the system controller 100.

The ink jet printing apparatus 10 comprises a parameter storage unit 134. The parameter storage unit 134 stores various parameters used in the ink jet printing apparatus 10. Various parameters stored in the parameter storage unit 134 are read via the system controller 100, and are set to each unit of the device.

The ink jet printing apparatus 10 comprises a program storage unit 136. The program storage unit 136 stores a program used in each unit of the ink jet printing apparatus 10. Various programs stored in the program storage unit 136 are read via the system controller 100, and are executed in each unit of the device.

The ink jet printing apparatus 10 comprises the in-line sensor 36. The system controller 100 acquires read data transmitted from the in-line sensor 36. The ink jet printing apparatus 10 executes various inspections on the basis of the read data.

The ink jet printing apparatus 10 comprises a dummy jet table storage unit 140. The dummy jet table storage unit 140 stores a table representing a relationship between a non-jettable period and a required jetting amount applied to the dummy jet, for each printing condition. Examples of the printing condition include the type of the ink jet head 32 and the type of ink.

The ink jet printing apparatus 10 comprises a dummy jet control unit 142. The dummy jet control unit 142 executes the dummy jet of the ink jet head 32 for each nozzle on the basis of the dummy jet condition. Examples of the dummy jet condition include the non-jettable period and the required jetting amount. Other examples of the dummy jet condition include a period from the printing start to the next jetting timing at a timing of determining the necessity of the execution of the dummy jet.

The dummy jet control unit 142 can comprise a dummy jet condition acquisition unit that acquires a dummy jet condition, and a dummy jet condition storage unit that stores a dummy jet condition. The dummy jet control unit 142 in the embodiment corresponds to an example of a dummy jet condition setting unit that sets the non-jettable period and the required jetting amount for each nozzle.

The dummy jet control unit 142 comprises a jetting amount derivation unit 144. The jetting amount derivation unit 144 calculates an integrated value of the jetting amount for each jetting timing on the basis of the image data to be applied to the printing.

The dummy jet control unit 142 comprises a determination unit 145. The determination unit 145 determines whether the dummy jet of the ink jet head 32 is executed on the basis of the integrated value of the jetting amount in the non-jettable period. Specifically, in a case where the integrated value of the jetting amount in the non-jettable period is less than the required jetting amount, the determination unit 145 determines that the dummy jet of the ink jet head 32 is executed. In a case where the next jetting is executed until the determination timing of the necessity of the next dummy jet, the determination unit 145 determines that the dummy jet of the ink jet head 32 is executed.

The dummy jet control unit 142 comprises a dummy jet jetting amount setting unit 146. The dummy jet jetting amount setting unit 146 sets the jetting amount of the ink for a dummy jet execution nozzle in a case of executing the dummy jet of the ink jet head 32. The dummy jet jetting amount setting unit 146 sets a value obtained by subtracting the integrated value of the jetting amount in the non-jettable period from the required jetting amount, as the jetting amount of the ink in the dummy jet.

The dummy jet control unit 142 comprises a dummy jet execution timing setting unit 147. The dummy jet execution timing setting unit 147 sets a timing to execute the dummy jet.

The dummy jet control unit 142 comprises a dummy jet parameter storage unit 148. The dummy jet parameter storage unit 148 stores parameters to be applied to the dummy jet. The details of the dummy jet will be described later.

[Description of Hardware Configuration]

Each processing unit illustrated in FIG. 3 can execute a prescribed program to realize the function of the ink jet printing apparatus 10 by using hardware described below. Various processors can be applied to the hardware of each processing unit. Examples of the processor include a CPU and a graphics processing unit (GPU). The CPU is a general-purpose processor functioning as each processing unit by executing the program. The GPU is a processor specialized in the image processing. As the hardware of the processor, an electric circuit that combines electric circuit elements such as semiconductor elements is applied. Each control unit comprises a ROM that stores a program and the like, and a RAM as a work area of various operations.

Two or more processors may be applied to one processing unit. The two or more processors may be the same type of processor or may be different types of processors. Further, one processor may be applied to a plurality of processing units.

The ink jet printing apparatus 10 described using FIG. 3 can realize various functions by executing a prescribed program using the above-described hardware. The program is synonymous with software.

[Detailed Description of Dummy Jet]

[Relationship Between Jettability Decrease and Dummy Jet]

In the ink jet head 32, latency which is a jetting delay due to drying of the ink on the nozzle surface may occur. The latency may occur in the nozzle that does not jet a certain amount of ink over a certain period. In a case where the latency progresses without recovering the latency, a jetting abnormality such as non-jetting may occur.

The ink jet printing apparatus 10 executes the dummy jet of the ink jet head 32 for each nozzle for the purpose of suppressing the occurrence of the latency and recovering the jettability in a case where the latency has occurred.

Figure 4:
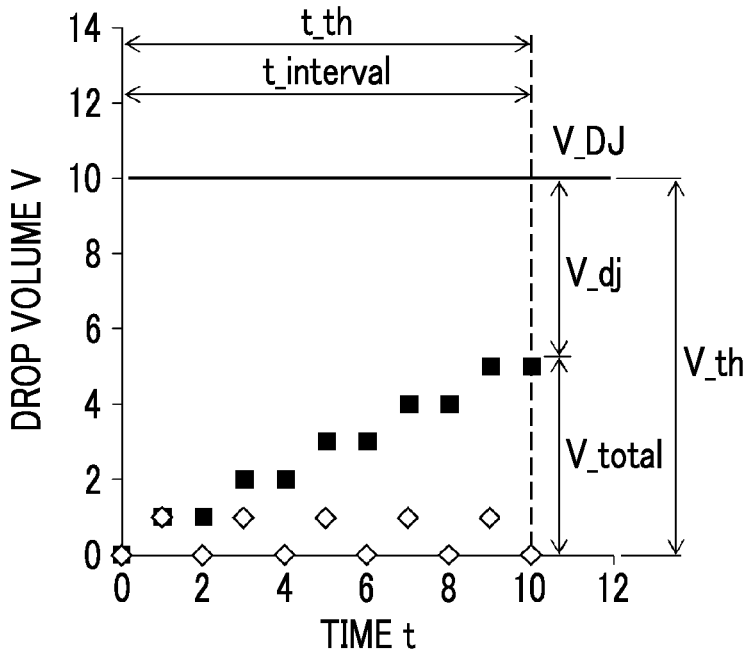
FIG. 4 is an explanatory diagram of a jettability decrease of an ink jet head.

FIG. 4 is an explanatory diagram of a jettability decrease of the ink jet head. FIG. 4 is a graph illustrating a relationship between time t and a drop volume V. The time t illustrated in FIG. 4 represents an elapsed period from the reset that represents the initialization of the dummy jet. The time t is represented using the number of unit periods. As the unit period, a period of an integral multiple of a jetting cycle may be applied.

In a case where the dummy jet is not reset when the dummy jet is executed, the elapsed period can be a period from the execution of the dummy jet. The drop volume V represents a drop volume in any nozzle. The drop volume V is represented using the number of unit drop volume. As the unit drop volume, a volume of the ink forming one dot may be applied. The drop volume V may represent the number of dots, the number of pixels, and the like.

A determination interval t_interval is a period to determine whether to execute the dummy jet. As the determination interval t_interval, any period equal to or less than a certain period in which the latency can occur may be applied. The determination interval t_interval in the graph illustrated in FIG. 4 is the longest period to determine whether to execute the dummy jet.

A recovery period t_th is a period required for jetting a jetting amount required for the latency recovery. In other words, the recovery period t_th represents the non-jettable period determined from the viewpoint of suppressing the occurrence of the latency. In the graph illustrated in FIG. 4, a case in which the recovery period t_th is set as the determination interval t_interval is illustrated.

The recovery period t_th in the embodiment corresponds to an example of the non-jettable period that is the upper limit of a non-jetting period in which the jettability decrease does not occur.

A recovery jetting amount V_th is a jetting amount required in a case where the latency is recovered. In other words, the recovery jetting amount V_th is a required jetting amount jetted in a certain period, which is determined from the viewpoint of suppressing the occurrence of the latency. The recovery jetting amount V_th corresponds to an example of the required jetting amount that is the lower limit of the jetting amount in the non-jettable period.

A total jetting amount V_total is an actual jetting amount jetted in the recovery period t_th using the printing start as a start timing. In the graph illustrated in FIG. 4, the jetting amount for each jetting timing is represented using a white marker, and the integrated value of the jetting amount for each jetting timing is represented using a black marker.

A dummy jet jetting amount V_dj is a jetting amount applied to the dummy jet. The dummy jet jetting amount V_dj is calculated by subtracting the total jetting amount V_total from the recovery jetting amount V_th. In the example illustrated in FIG. 4, it is determined whether to execute the dummy jet in a case of the time t=10, and in the case of the time t=10, it is satisfied that V_total<V_th, and the dummy jet to jet the dummy jet jetting amount V_dj=V_th−V_total is executed.

Figure 5:
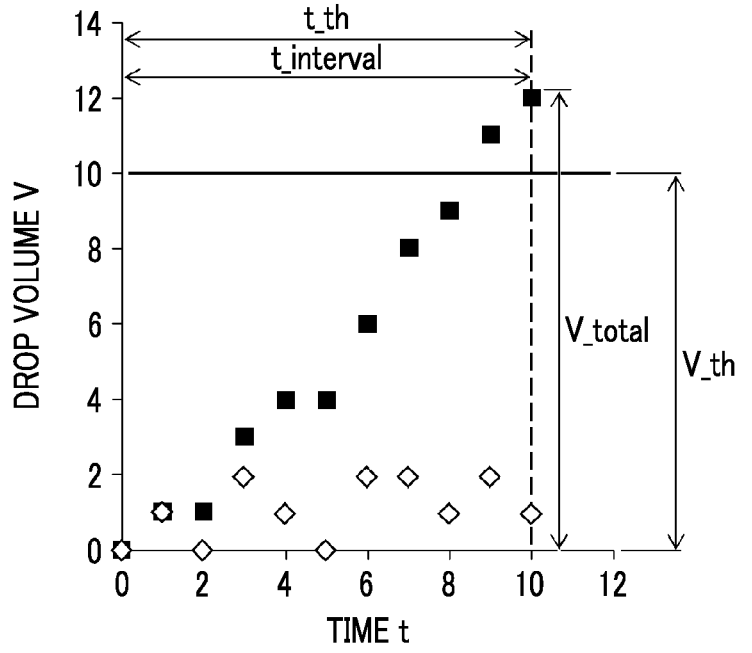
FIG. 5 is an explanatory diagram of a case where a dummy jet is not executed.

FIG. 5 is an explanatory diagram of a case where a dummy jet is not executed. In the graph illustrated in FIG. 5, in the case of the time t=10, it is satisfied that V_total>V_th, and it is determined that the dummy jet is not executed.

The setting of the dummy jet illustrated in FIGS. 4 and 5 may be executed in units of jobs, on the basis of the image data to be applied to the printing. The setting of the dummy jet may be sequentially executed during the execution of the printing, and may be set and stored in advance before the execution of the printing.

Figure 6:
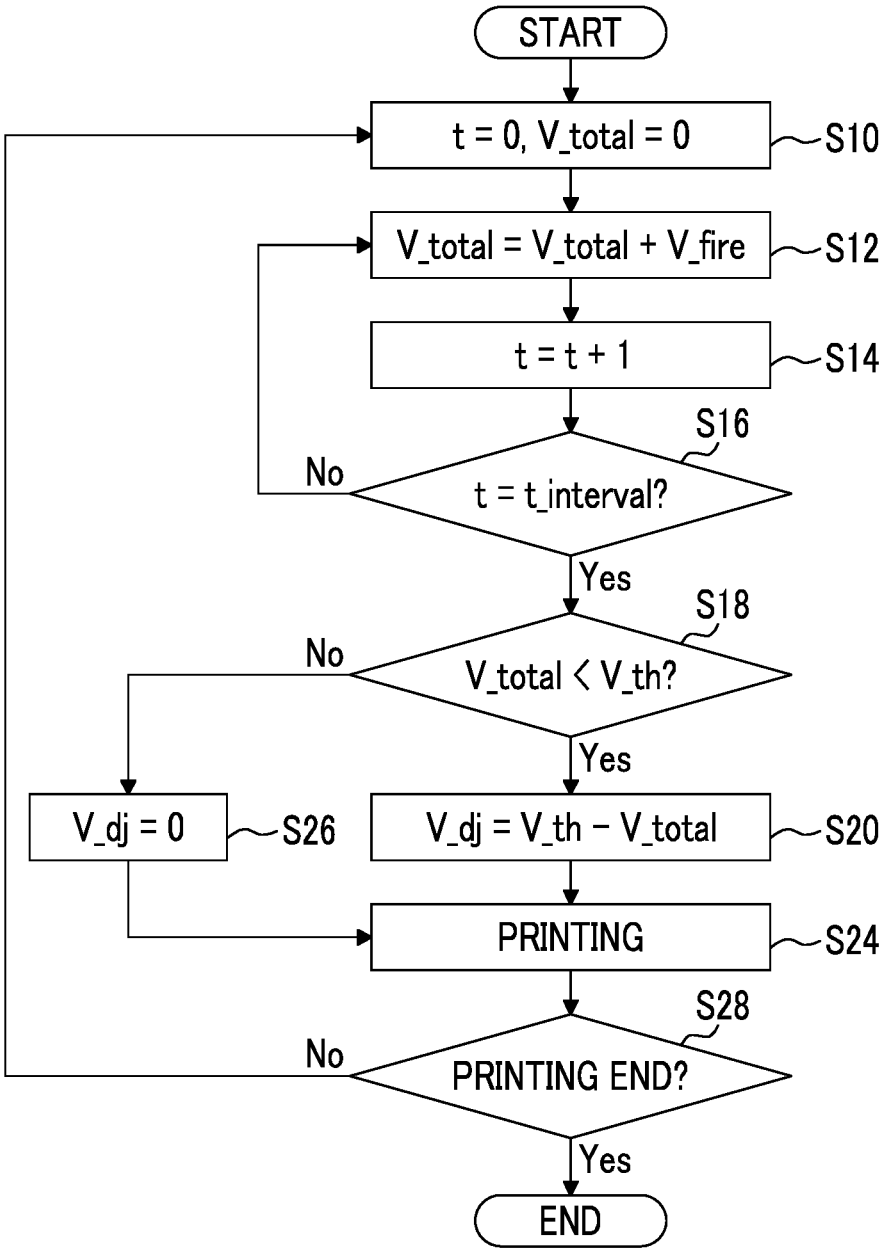
FIG. 6 is a flowchart illustrating a procedure of a dummy jet method.

FIG. 6 is a flowchart illustrating a procedure of a dummy jet method. In FIG. 6, the procedure of the dummy jet method in a case where the execution timing of the dummy jet is predetermined and fixed is illustrated. The time t illustrated in FIG. 6 represents the jetting timing. The same applies to the time t illustrated in FIGS. 8 to 10.

In a dummy jet reset step S10, the dummy jet control unit 142 illustrated in FIG. 3 executes the reset of the dummy jet. Specifically, in the dummy jet reset step S10, time t=0 and the total jetting amount V_total=0. After the dummy jet reset step S10, the processing proceeds to a jetting amount update step S12.

In the jetting amount update step S12, the jetting amount derivation unit 144 updates the jetting amount. That is, in a case where V_fire is set as the jetting amount for each jetting timing, it is satisfied that the total jetting amount V_total=V_total+V_fire. The jetting amount V_fire for each jetting timing may be calculated on the basis of the image data. After the jetting amount update step S12, the processing proceeds to a timing update step S14.

In the timing update step S14, the dummy jet control unit 142 updates the time t illustrated in FIG. 4. Specifically, the dummy jet control unit 142 sets time t=t+1. After the timing update step S14, the processing proceeds to a timing determination step S16.

In the timing determination step S16, the determination unit 145 determines whether the time t is a dummy jet determination timing. In the timing determination step S16, in a case where the determination unit 145 determines that it is not satisfied that time t=t_interval, a No determination is made, and the processing proceeds to the jetting amount update step S12. After that, until a Yes determination is made in the timing determination step S16, each step from the jetting amount update step S12 to the timing determination step S16 is repeatedly executed.

On the other hand, in the timing determination step S16, in a case where the determination unit 145 determines that it is satisfied that time t=t_interval, a Yes determination is made, and the processing proceeds to a jetting amount determination step S18.

In the jetting amount determination step S18, the determination unit 145 determines whether it is satisfied V_total<V_th. In the jetting amount determination step S18, in a case where the determination unit 145 determines that it is satisfied that V_total>V_th, a No determination is made, and the processing proceeds to a dummy jet non-execution setting step S26.

In the dummy jet non-execution setting step S26, the dummy jet jetting amount setting unit 146 sets non-execution of the dummy jet. That is, in the dummy jet non-execution setting step S26, the dummy jet jetting amount V_dj=0 is set. After the dummy jet non-execution setting step S26, the processing proceeds to a printing step S24.

On the other hand, in the jetting amount determination step S18, in a case where the determination unit 145 determines that it is satisfied that V_total<V_th, a Yes determination is made, and the processing proceeds to a dummy jet jetting amount setting step S20. In the dummy jet jetting amount setting step S20, the dummy jet jetting amount V_dj=V_th−V_total is set as the dummy jet jetting amount V_dj. After the dummy jet jetting amount setting step S20, the processing proceeds to the printing step S24.

In the printing step S24, the printing control unit 122 executes printing in units of print jobs using the printing unit 30. In the printing step S24, the dummy jet control unit 142 executes the dummy jet of the ink jet head 32 at a dummy jet execution timing t_dj set in advance.

In the example illustrated in FIG. 4, as the dummy jet execution timing t_dj, an arbitrary timing after the timing of determining the necessity of the execution of the dummy jet is applied. The printing step S24 in the embodiment corresponds to an example of a dummy jet step.

During the execution of the printing step S24, the printing control unit 122 determines whether to end the printing in a printing end determination step S28. In the printing end determination step S28, in a case where the printing control unit 122 determines that a prescribed printing end condition is not satisfied, a No determination is made. Examples of the printing end condition include a case where printing of the prescribed number of prints in the print job is executed, a case where a forced printing end command is issued, and the like.

In a case of the No determination, the processing proceeds to the dummy jet reset step S10. After that, until a Yes determination is made in the printing end determination step S28, each step from the dummy jet reset step S10 to the printing end determination step S28 is repeatedly executed.

On the other hand, in the printing end determination step S28, in a case where the printing control unit 122 determines that a prescribed printing end condition is satisfied, a Yes determination is made, and the printing control unit 122 executes printing end processing to end the printing.

[Description of Form in which Execution Timing of Dummy Jet is Changed]

Figure 7:
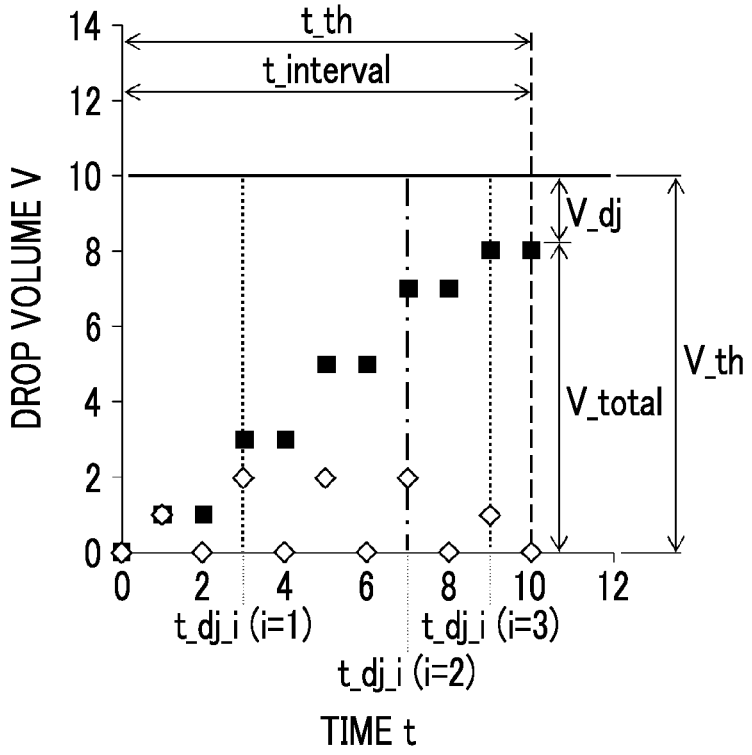
FIG. 7 is an explanatory diagram of a form in which an execution timing of a dummy jet is changed.

FIG. 7 is an explanatory diagram of a form in which the execution timing of the dummy jet is changed. Hereinafter, a case where the dummy jet is executed a plurality of times by changing the execution timing of the dummy jet in the period of the determination interval t_interval will be described. t_dj_i illustrated in FIG. 7 indicates the execution timing of the i-th dummy jet in a case where i is an integer of 1 or more.

In the example illustrated in FIG. 7, the execution condition of the dummy jet described using FIG. 6 is satisfied, and the dummy jet is executed at time t=3, time t=7, and time t=9. In the example illustrated in FIG. 7, the dummy jet jetting amount V_dj is dispersed in three times of dummy jets.

Figure 8:
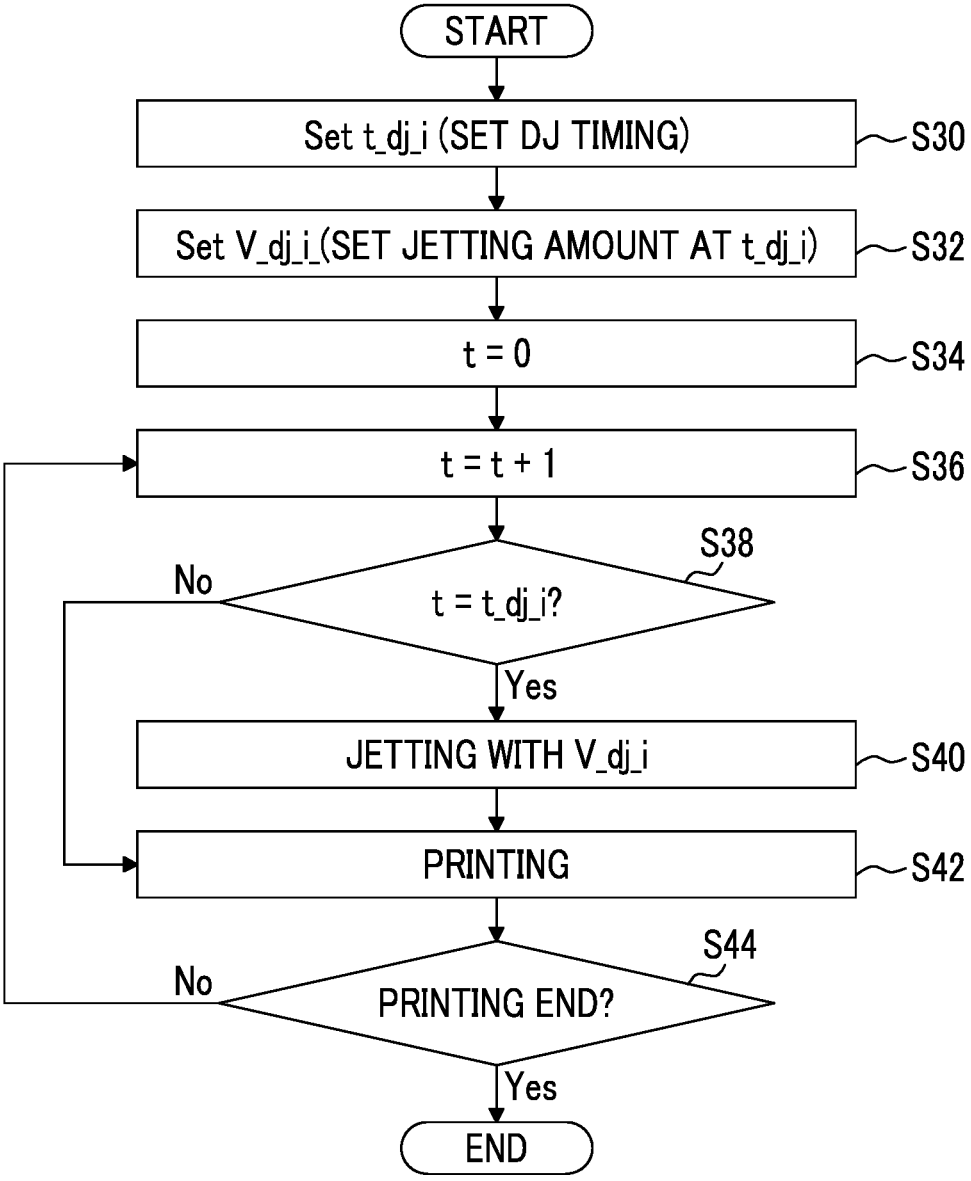
FIG. 8 is a flowchart illustrating a procedure of a dummy jet method in the form in which the execution timing of the dummy jet is changed.

FIG. 8 is a flowchart illustrating a procedure of the dummy jet method in the form in which the execution timing of the dummy jet is changed. In a dummy jet timing setting step S30, the dummy jet execution timing setting unit 147 sets a dummy jet execution timing t_dj_i. In the example illustrated in FIG. 7, setting is performed such that time t=3 with i=1, time t=7 with i=2, and time t=9 with i=3. After the dummy jet timing setting step S30, the processing proceeds to a dummy jet jetting amount setting step S32.

In the dummy jet jetting amount setting step S32, the dummy jet jetting amount setting unit 146 sets a jetting amount V_dj_i for each timing at which the dummy jet is executed. After the dummy jet jetting amount setting step S32, the processing proceeds to a timing reset step S34.

In the timing reset step S34, the dummy jet control unit 142 resets the time t illustrated in FIG. 7. After the timing reset step S34, the processing proceeds to a timing update step S36.

In the timing update step S36, the dummy jet control unit 142 increments the time t illustrated in FIG. 7 by one, and updates the time t. After the timing update step S36, the processing proceeds to a dummy jet execution timing determination step S38.

In the dummy jet execution timing determination step S38, the determination unit 145 determines whether the time t is the dummy jet execution timing t_dj_i. In the dummy jet execution timing determination step S38, in a case where the determination unit 145 determines that the time t is not the dummy jet execution timing t_dj_i, a No determination is made. In a case of the No determination, the processing proceeds to a printing step S42.

On the other hand, in the dummy jet execution timing determination step S38, in a case where the determination unit 145 determines that the time t is the dummy jet execution timing t_dj_i, a Yes determination is made. In a case of the Yes determination, the processing proceeds to a dummy jet execution step S40.

In the dummy jet execution step S40, the dummy jet control unit 142 executes the dummy jet by applying the jetting amount set in the dummy jet jetting amount setting step S32. After the dummy jet execution step S40, the processing proceeds to the printing step S42.

In the printing step S42, the printing control unit 122 executes printing using the printing unit 30. During the execution of the printing step S42, the printing control unit 122 determines whether to end the printing in a printing end determination step S44. In the printing end determination step S44, in a case where the printing control unit 122 determines that a prescribed printing end condition is not satisfied, a No determination is made. Examples of the printing end condition include a case where printing of the prescribed number of prints in the print job is executed, a case where a forced printing end command is issued, and the like.

In a case of the No determination, the processing proceeds to the timing update step S36. After that, until a Yes determination is made in the printing end determination step S44, each step from the timing update step S36 to the printing end determination step S44 is repeatedly executed.

On the other hand, in the printing end determination step S44, in a case where the printing control unit 122 determines that a prescribed printing end condition is satisfied, a Yes determination is made, and the printing control unit 122 executes printing end processing to end the printing.

Dummy Jet Method According to First Embodiment

Figure 9:
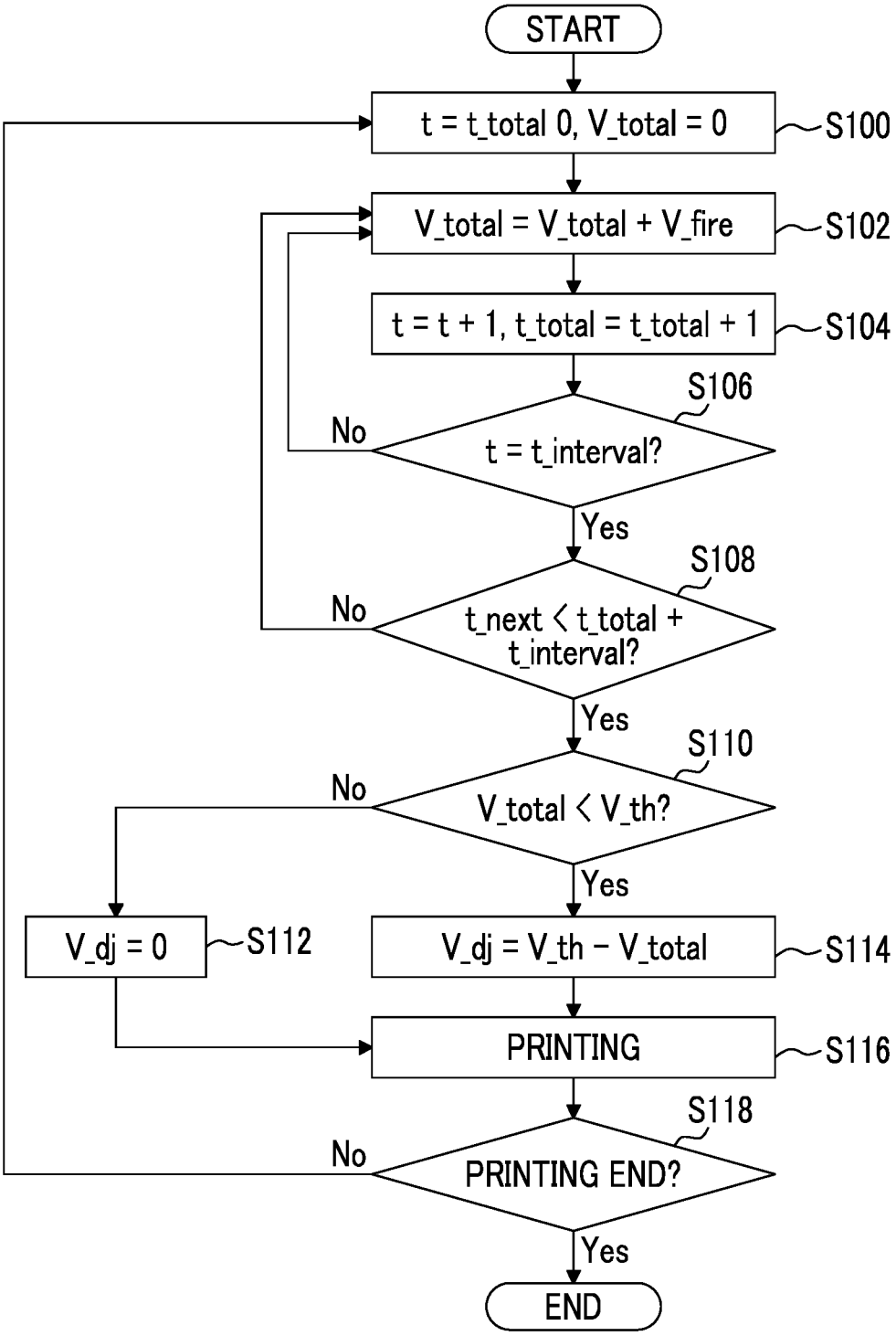
FIG. 9 is a flowchart illustrating a procedure of a dummy jet method according to a first embodiment.

FIG. 9 is a flowchart illustrating a procedure of a dummy jet method according to a first embodiment. In the dummy jet method according to the first embodiment, the necessity of the execution of the dummy jet is determined in consideration of the next jetting.

A dummy jet reset step S100 illustrated in FIG. 9 corresponds to the dummy jet reset step S10 illustrated in FIG. 6. Similarly, a jetting amount update step S102 illustrated in FIG. 9 corresponds to the jetting amount update step S12 illustrated in FIG. 6. Here, the detailed description is omitted.

In a timing update step S104, the dummy jet control unit 142 illustrated in FIG. 3 updates the time t and a printing elapsed period t_total. The printing elapsed period t_total is an elapsed period using the printing start as a start timing.

Specifically, the dummy jet control unit 142 sets time t=t+1 and printing elapsed period t_total=t_total+1. After the timing update step S104, the processing proceeds to a timing determination step S106.

The timing determination step S106 corresponds to the timing determination step S16 illustrated in FIG. 6. In a case of time t≠t_interval, the processing returns to the jetting amount update step S102, and in a case of time t=t_interval, the processing proceeds to a next jetting determination step S108.

In the next jetting determination step S108, the determination unit 145 determines whether the period from the printing start timing to a next jetting timing t_next is less than t_total+t_interval.

In the next jetting determination step S108, in a case where the determination unit 145 determines that the period from the printing start timing to the next jetting timing t_next is equal to or greater than t_total+t_interval, a No determination is made. In a case of the No determination, the processing proceeds to the jetting amount update step S102, and until a Yes determination is made in the next jetting determination step S108, each step from the jetting amount update step S102 to the next jetting determination step S108 is repeatedly executed.

On the other hand, in the next jetting determination step S108, in a case where the determination unit 145 determines that the period from the printing start timing to the next jetting timing t_next is less than t_total+t_interval, a Yes determination is made. In a case of the Yes determination, the processing proceeds to a jetting amount determination step S110.

That is, in a case where the nozzle as a processing target is not used before determining the necessity of the execution of the next dummy jet, the dummy jet of the nozzle as the processing target is not executed. On the other hand, in a case where the nozzle as the processing target is used before determining the necessity of the execution of the next dummy jet, the dummy jet of the nozzle as the processing target is executed.

The jetting amount determination step S110, a dummy jet non-execution setting step S112, a dummy jet jetting amount setting step S114, a printing step S116, and a printing end determination step S118 illustrated in FIG. 9 correspond to the jetting amount determination step S18, the dummy jet non-execution setting step S26, the dummy jet jetting amount setting step S20, the printing step S24, and the printing end determination step S28 illustrated in FIG. 6, respectively.

The dummy jet method of which the procedure is illustrated in FIG. 9 may include a dummy jet condition acquisition step of acquiring the dummy jet condition for each nozzle, a dummy jet condition storage step of storing the acquired dummy jet condition, and a dummy jet condition setting step of setting the dummy jet condition. The same applies to the dummy jet method illustrated in FIG. 6.

In a case where the maintenance of the ink jet head 32 is executed before the execution of the print job or after the execution of the print job, the drying state of the ink in the nozzle is recovered, and therefore, the dummy jet can be executed without considering the presence or absence of the jetting in the next print job or the like.

On the other hand, in a case where the maintenance of the ink jet head 32 is not executed before the execution of the print job or the like, the dummy jet in consideration of the next jetting is executed to suppress a decrease in the jettability.

Effects of First Embodiment

With the dummy jet method according to the first embodiment configured as described above, the following effects can be obtained.

[1]

At the timing of determining the necessity of the execution of the dummy jet, in a case where a period from the printing start to the next jetting timing t_next is less than a period that is obtained by adding the determination interval t_interval as the period to determine whether to execute the dummy jet, to the printing elapsed period t_total, the dummy jet is executed. In this manner, a decrease in the jettability is suppressed, and the execution of an unnecessary dummy jet is suppressed.

[2]

The jetting amount in a case where the dummy jet is executed is calculated by subtracting the integrated value of the jetting amounts from the printing start, from the jetting amount required in a case of recovering the decrease in the jettability such as the latency. In this manner, it is possible to optimize the jetting amount in the dummy jet in detail.

[3]

The longest period in which a decrease in the jettability such as the latency can occur is set as the determination interval t_interval that is a period to determine whether to execute the dummy jet. In this manner, it is possible to reduce the ink consumption amount in the dummy jet as compared with a case where the dummy jet is periodically executed.

[4]

The ink jetting amount for each nozzle is calculated on the basis of the image data to be applied to the printing. In this manner, it is possible to optimize the jetting amount in the dummy jet for each nozzle.

Dummy Jet Method According to Second Embodiment

Figure 10:
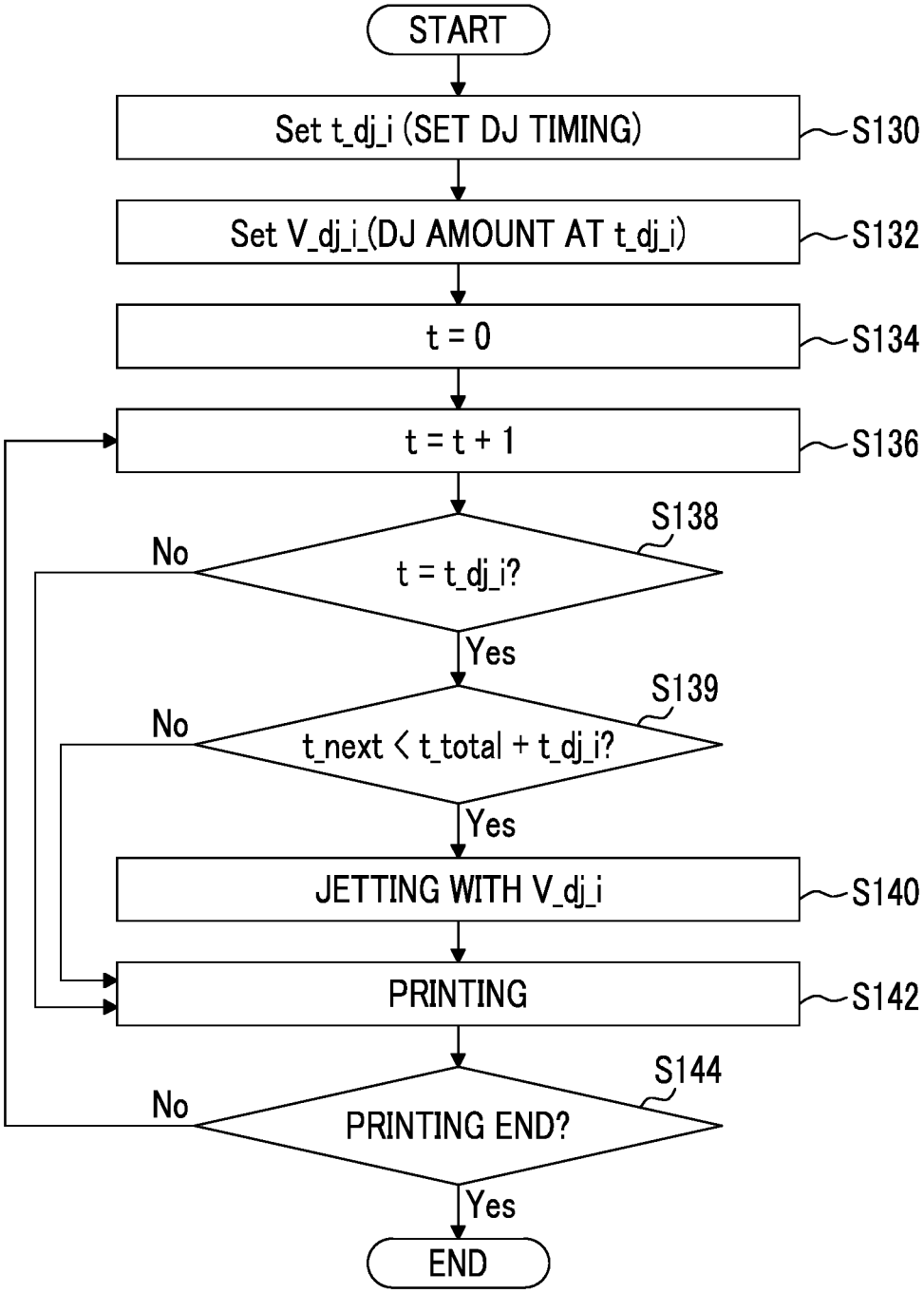
FIG. 10 is a flowchart illustrating a procedure of a dummy jet method according to a second embodiment.

FIG. 10 is a flowchart illustrating a procedure of a dummy jet method according to a second embodiment. The form in which the execution timing of the dummy jet is changed illustrated in FIG. 7 is applied to the dummy jet method according to the second embodiment.

A dummy jet timing setting step S130, a dummy jet jetting amount setting step S132, a timing reset step S134, a timing update step S136, and a dummy jet execution timing determination step S138 illustrated in FIG. 10 correspond to the dummy jet timing setting step S30 to the dummy jet execution timing determination step S38 illustrated in FIG. 8, respectively.

In the dummy jet execution timing determination step S138, in a case where the determination unit 145 illustrated in FIG. 3 determines that the time t is not the dummy jet execution timing t_dj_i, a No determination is made. In a case of the No determination, the processing proceeds to a printing step S142.

On the other hand, in the dummy jet execution timing determination step S138, in a case where the determination unit 145 determines that the time t is the dummy jet execution timing t_dj_i, a Yes determination is made. In a case of the Yes determination, the processing proceeds to a next jetting determination step S139.

In the next jetting determination step S139, the determination unit 145 determines whether the period from the printing start to the next jetting timing t_next is less than a period obtained by adding a period to the next dummy jet execution timing, to the printing elapsed period t_total.

That is, in the next jetting determination step S139, at the dummy jet execution timing set in advance, it is determined whether it is a nozzle that does not execute the next jetting until the next dummy jet execution timing.

In the next jetting determination step S139, in a case where the determination unit 145 determines that the period from the printing start to the next jetting timing t_next is equal to or greater than the period obtained by adding the period to the next dummy jet execution timing, to the printing elapsed period t_total, a No determination is made. In a case of the No determination, the processing proceeds to the printing step S142.

On the other hand, in the next jetting determination step S139, in a case where the determination unit 145 determines that the period from the printing start to the next jetting timing t_next is less than the period obtained by adding the period to the next dummy jet execution timing, to the printing elapsed period t_total, a Yes determination is made. In a case of the Yes determination, the processing proceeds to a dummy jet execution step S140.

The dummy jet execution step S140 illustrated in FIG. 10 corresponds to the dummy jet execution step S40 illustrated in FIG. 8. The printing step S142 illustrated in FIG. 10 corresponds to the printing step S42 illustrated in FIG. 8. Further, the printing end determination step S144 illustrated in FIG. 10 corresponds to the printing end determination step S44 illustrated in FIG. 8.

That is, at the dummy jet execution timing, in a case where it is a nozzle that does not execute the next jetting until the next dummy jet execution timing, the dummy jet is not executed. On the other hand, at the dummy jet execution timing, in a case where it is a nozzle that executes the next jetting until the next dummy jet execution timing, the dummy jet is executed.

Effects of Second Embodiment

With the dummy jet method according to the second embodiment configured as described above, the following effects can be obtained.

[1]

The dummy jet execution timing is changed. In this manner, it is possible to optimize the dummy jet execution timing.

[2]

The execution timings of the plurality of times of the dummy jet are set. In this manner, it is possible to optimize the dummy jet execution timing. It is possible to optimize the jetting amount for each dummy jet execution timing.

[Description of Jetting Region of Dummy Jet]

Application Example of Glue Region

Figure 11:
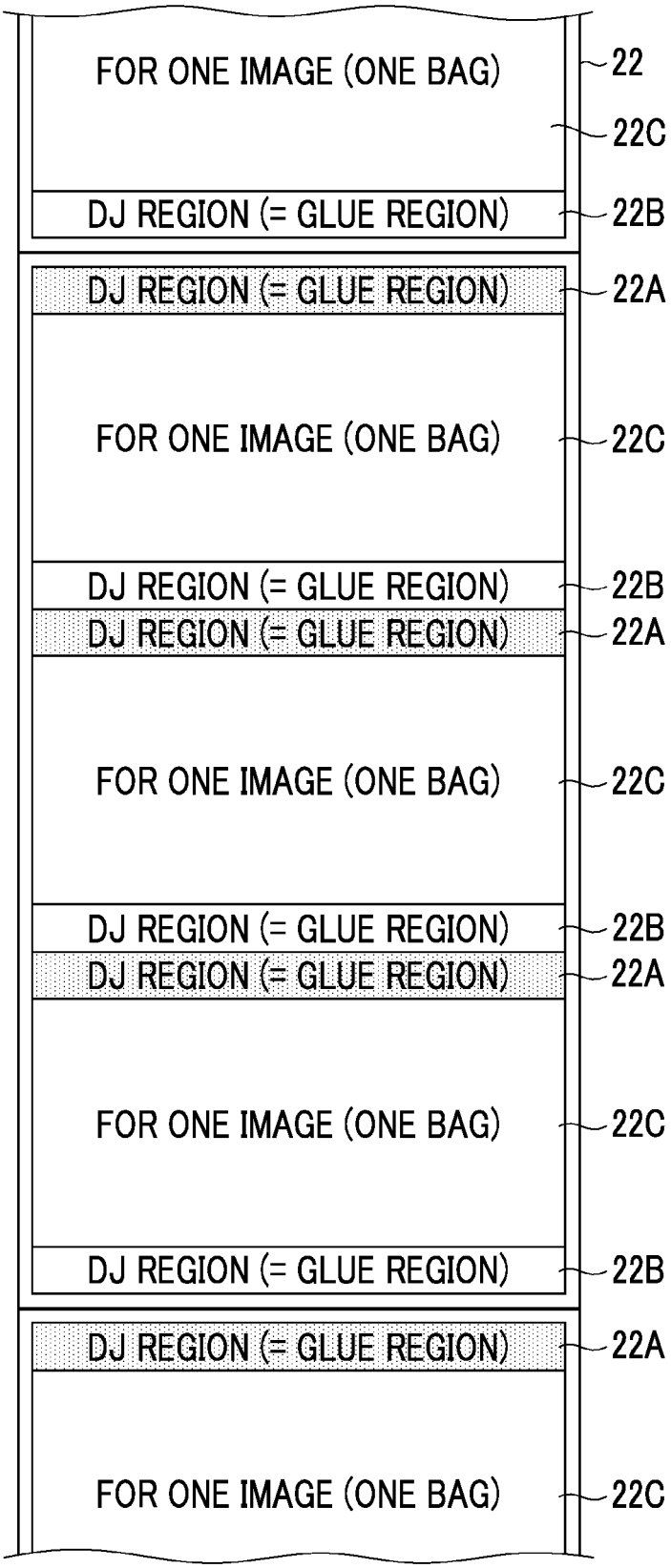
FIG. 11 is an explanatory diagram of an example of a case in which a dummy jet is executed to a glue region.
Figure 12:
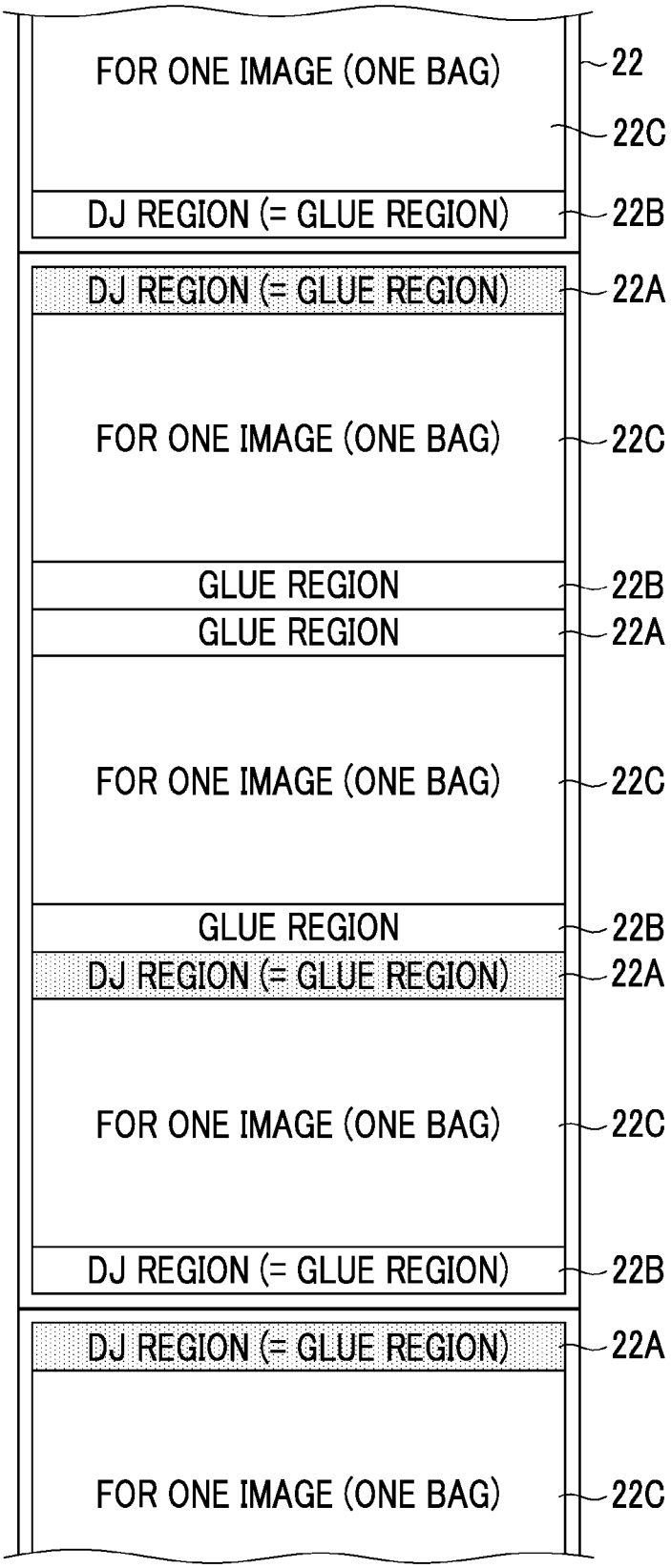
FIG. 12 is an explanatory diagram of another example of a case in which the dummy jet is executed to the glue region.

FIG. 11 is an explanatory diagram of an example of a case in which the dummy jet is executed to a glue region. FIG. 12 is an explanatory diagram of another example of a case in which the dummy jet is executed to the glue region. In a case of the printing on the continuous paper 22, such as printing for bag making, it may be difficult to use a region between pages as a dummy jet region.

That is, the paper 22 wound around the roll, such as flexible packaging has no cutting region in a case of sheet paper, or has a smaller cutting region than the sheet paper, and in such a case, the flexible packaging or the like has not dummy jet region, or has a smaller dummy jet region than the sheet paper.

As illustrated in FIGS. 11 and 12, in a case of the printing or the like for bag making, it is possible to execute the dummy jet to the glue region. In the example illustrated in FIG. 11, the dummy jet is executed to a first glue region 22A of each page. In the example illustrated in FIG. 12, the dummy jet is executed to the first glue region 22A of every other page. The first glue region 22A illustrated with a dot hatch in FIGS. 11 and 12 represents the jetting region of the dummy jet.

The dummy jet may be executed to a second glue region 22B instead of the first glue region 22A. As the jetting region of the dummy jet, the first glue region 22A and the second glue region 22B may be used in combination.

In a case where the dummy jet is executed to the glue region, it is possible to suppress the influence of the dummy jet on an image region 22C illustrated in FIG. 11 or the like.

In a case where the glue region is applied as the jetting region of the dummy jet, the determination interval t_interval illustrated in FIG. 7 or the like may be set to an integral multiple of the printing period of one page. That is, the necessity of the execution of the dummy jet may be determined in units of pages.

The first glue region 22A and the second glue region 22B described in the embodiment correspond to an example of a boundary region of a page.

Application Example of Image Region

In the case of the flexible packaging or the like, the dummy jet may be executed by being scattered to the image region 22C illustrated in FIG. 11 or the like. In a case where the dummy jet is executed to the image region 22C, the jetting amount of the dummy jet is set to the minimum necessary in consideration of the influence on the image region 22C.

In a case where the dummy jet is executed to the image region 22C, a form in which the dummy jet execution timing is changed illustrated in FIG. 7, and a form in which the execution of a plurality of times of dummy jet is set for determining the necessity of the execution of one dummy jet may be applied.

In a case where the dummy jet is executed to the image region 22C, the dummy jet execution timing t_dj is set as a timing at which the nozzle is at a position with the largest difference in brightness and a position with the largest density in a print range of each nozzle in a print image. In this manner, visibility in the print image of dots formed by the dummy jet may be reduced.

Application Example of Roll Distal End Portion

In the case of the flexible packaging or the like, a distal end portion of the roll may be applied as the jetting region of the dummy jet. In such a form, the dummy jet of all the nozzles is executed at time t=0 illustrated in FIG. 4 or the like. By discarding the distal end portion of the roll, the influence of the dummy jet on the image region can be suppressed.

[Estimation of Rest Period and Latency Recovery Amount]

FIG. 13 is an explanatory diagram of the estimation of a rest period and a latency recovery amount. The degree of latency differs depending on the ink jet head to be used, the ink to be used, and the like. Thus, it is preferable to create in advance a table representing a relationship between the rest period and the latency recovery amount for each ink jet to be used and for each ink to be used. The rest period corresponds to the recovery period t_th, and the latency recovery amount corresponds to the recovery jetting amount V_th.

Table 200 illustrated in FIG. 13 illustrates a relationship between the rest period and the latency recovery amount for two types of inks. The following procedure is applied to derive the relationship between the rest period and the latency recovery amount illustrated in Table 200.

The ink jet head applied in a case of deriving a relationship between the rest period and the latency recovery amount is a line type, and the ink jet head executes single pass printing. As the environment applied in a case of deriving a relationship between the rest period and the latency recovery amount, an environment in the printing state of the ink jet head may be applied.

The ink jet head is maintained in a non-jetting state for a certain period from the timing of resetting the jetting state. A solid image is printed after a certain period has elapsed. A test image is printed after the solid image is formed. By changing ink jetting amount applied to the printing of the solid image, non-jetting for a certain period, the printing of the solid image, and the printing of the test image are executed. The degree of the latency is evaluated by analyzing the test image.

A well-known technique is applied for the test image and the analysis of the test image. A well-known technique that can evaluate the jetting delay for each nozzle is applied for the evaluation of the degree of the latency.

FIG. 13 illustrates evaluation results in a case where the ink jetting amount is 5, 10, 20, 50, and 100 for the non-jetting period of 1 minute, 10 minutes, 30 minutes, and 60 minutes. The ink jetting amount illustrated in FIG. 13 is a relative value in a case where the ink jetting amount forming one dot is 1.

The evaluation result A illustrated in FIG. 13 indicates a case where a decrease in the jettability is not observed. The evaluation result B indicates a case where a decrease in the jettability is observed but an allowable printing condition is present. The evaluation result C indicates a case where a decrease in the jettability outside the allowable range is observed.

For the ink α, in a case where the non-jetting period is equal to or less than 60 minutes, it is possible to recover the jettability by executing the dummy jet with the jetting amount of 100. For the ink β, in a case where the non-jetting period is equal to or less than 60 minutes, it is possible to recover the jettability by executing the dummy jet with the jetting amount of 50.

For the ink α and the ink β, a table applied for determining the necessity of the execution of the dummy jet in the ink jet head to be used can be created on the basis of Table 200 illustrated in FIG. 13. It is preferable that the table applied for determining the necessity of the execution of the dummy jet is created for each nozzle. For example, in a case of the ink jet head including a plurality of head modules, the table applied for determining the necessity of the execution of the dummy jet may be created for each head module.

Application Example to Program

A program corresponding to the ink jet printing apparatus 10 and the dummy jet method disclosed in the present specification can be configured. That is, the present specification discloses a program causing a computer to execute a dummy jet condition setting function of setting a non-jettable period and a required jetting amount of the ink jet head, for each nozzle; and a dummy jet function of executing a dummy jet for a dummy jet execution nozzle with a jetting amount insufficient for the required jetting amount, in which, at a determination timing, for the nozzle of which a total jetting amount in the non-jettable period is less than the required jetting amount, the dummy jet function executes a dummy jet in a case where a period from a printing start to a next jetting timing is less than a period obtained by adding a determination interval to a period from the printing start to the determination timing, and does not execute a dummy jet in a case where the period from the printing start to the next jetting timing is equal to or greater than the period obtained by adding the determination interval to the period from the printing start to the determination timing.

In the embodiments of the present invention described above, configuration requirements can be changed, added, or deleted as appropriate in a range without departing from the gist of the invention. The present invention is not limited to the embodiments described above, and many modifications are possible by a person with ordinary skill in the corresponding field within the technical idea of the present invention.

EXPLANATION OF REFERENCES

10: ink jet printing apparatus
20: paper feeding unit
22: paper
22A: first glue region
22B: second glue region
22C: image region
24: feed roll
30: printing unit
32: ink jet head
32C: ink jet head
32M: ink jet head
32Y: ink jet head
32K: ink jet head
34: printing drum
34A: outer peripheral surface
34B: shaft
36: in-line sensor
40: drying unit
42: paper transport device
44: drying device
50: paper discharge unit
52: winding roll
100: system controller
110: communication unit
112: image memory
114: host computer
120: transport control unit
121: transport unit
122: printing control unit
124: drying control unit
126: paper discharge control unit
130: operation unit
132: display unit
134: parameter storage unit
136: program storage unit
140: dummy jet table storage unit
142: dummy jet control unit
144: jetting amount derivation unit
145: determination unit
146: dummy jet jetting amount setting unit
147: dummy jet execution timing setting unit
148: dummy jet parameter storage unit
S10 to S144: each step of dummy jet method

What is claimed is:

1. An ink jet printing apparatus comprising:

an ink jet head that includes nozzles for jetting an ink;

a dummy jet condition setting unit that sets a non-jettable period as an upper limit of a non-jetting period in which a jettability decrease of the ink jet head does not occur, and a required jetting amount as a lower limit of a jetting amount in the non-jettable period, for each nozzle; and a dummy jet control unit that executes a dummy jet for a dummy jet execution nozzle with a jetting amount insufficient for the required jetting amount, wherein, at a determination timing of determining necessity of execution of a dummy jet, the dummy jet control unit executes a dummy jet in a case where a period from a printing start to a next jetting timing is less than a period obtained by adding a determination interval to a period from the printing start to the determination timing, and does not execute a dummy jet in a case where the period from the printing start to the next jetting timing is equal to or greater than the period obtained by adding the determination interval to the period from the printing start to the determination timing, for the nozzle of which a total jetting amount in the non-jettable period is less than the required jetting amount.

2. The ink jet printing apparatus according to claim 1, wherein the dummy jet control unit determines whether to execute the dummy jet by applying a period that is an integral multiple of a printing period of one page.

3. The ink jet printing apparatus according to claim 1, further comprising:

a transport unit that transports a continuous printing medium.

4. The ink jet printing apparatus according to claim 3, wherein the dummy jet control unit executes the dummy jet to a boundary region of a page of the continuous printing medium.

5. The ink jet printing apparatus according to claim 1, wherein the dummy jet control unit executes the dummy jet in a printing period of a print image according to a content of the print image.

6. The ink jet printing apparatus according to claim 1, wherein the dummy jet control unit executes the dummy jet a plurality of times until the non-jettable period has elapsed from the printing start.

7. The ink jet printing apparatus according to claim 1, wherein the dummy jet control unit initializes an elapsed period from the printing start and an ink jetting amount from the printing start, for the nozzle in which the dummy jet has been executed.

8. The ink jet printing apparatus according to claim 1, wherein the dummy jet control unit executes the dummy jet for all the nozzles at a timing at which an elapsed period from the printing start and an ink jetting amount from the printing start are initialized.

9. The ink jet printing apparatus according to claim 1, wherein the dummy jet control unit comprises a dummy jet condition acquisition unit that acquires a relationship between the non-jettable period and the required jetting amount for each printing condition.

10. The ink jet printing apparatus according to claim 1, further comprising:

a dummy jet condition storage unit that stores a relationship between the non-jettable period and the required jetting amount for each printing condition.

11. A dummy jet method comprising:

a dummy jet condition setting step of setting a non-jettable period as an upper limit of a non-jetting period in which a jettability decrease of an ink jet head including nozzles for jetting an ink does not occur, and a required jetting amount as a lower limit of a jetting amount in the non-jettable period, for each nozzle; and a dummy jet step of executing a dummy jet for a dummy jet execution nozzle with a jetting amount insufficient for the required jetting amount, wherein, at a determination timing of determining necessity of execution of a dummy jet, the dummy jet step executes a dummy jet in a case where a period from a printing start to a next jetting timing is less than a period obtained by adding a determination interval to a period from the printing start to the determination timing, and does not execute a dummy jet in a case where the period from the printing start to the next jetting timing is equal to or greater than the period obtained by adding the determination interval to the period from the printing start to the determination timing, for the nozzle of which a total jetting amount in the non-jettable period is less than the required jetting amount.

12. A non-transitory computer-readable recording medium that causes a computer to execute the dummy jet method according to claim 11 in a case where a command stored in the recording medium is read by the computer.

* * * * *